US006527497B2

(12) United States Patent
Perry

(10) Patent No.: US 6,527,497 B2
(45) Date of Patent: Mar. 4, 2003

(54) LOAD BEARING ATTACHMENT APPARATUS FOR A MULTIPURPOSE LOADER BUCKET

(75) Inventor: James A. Perry, Pleasanton, CA (US)

(73) Assignee: Perrybuilt Incorporated, Pleasanton, CA (US)

( * ) Notice: Subject to any disclaimer, the term of this patent is extended or adjusted under 35 U.S.C. 154(b) by 6 days.

(21) Appl. No.: 09/823,333

(22) Filed: Mar. 29, 2001

(65) Prior Publication Data

US 2001/0048873 A1 Dec. 6, 2001

Related U.S. Application Data

(63) Continuation-in-part of application No. 09/396,302, filed on Sep. 15, 1999, now Pat. No. 6,287,070.

(51) Int. Cl.[7] ..... E02F 7/04

(52) U.S. Cl. ..... 414/724; 414/912; 37/405; 37/903

(58) Field of Search ..... 414/724, 912; 37/403, 405, 903

(56) References Cited

U.S. PATENT DOCUMENTS

| | | | |
|---|---|---|---|
| 3,325,023 | A | 6/1967 | Coleman |
| 3,349,933 | A | 10/1967 | Simpson et al. |
| 3,421,642 | A | 1/1969 | Carter |
| 3,667,633 | A | 6/1972 | Cappella |
| 3,706,388 | A | 12/1972 | Westendorf |
| 3,795,331 | A | 3/1974 | Guest |
| 3,908,844 | A | 9/1975 | Duffield |
| 3,938,680 | A | 2/1976 | Grimes |
| 4,125,952 | A | 11/1978 | Jennings |
| 4,242,035 | A | 12/1980 | Hornstein |
| 4,329,103 | A | 5/1982 | Miller |
| 4,411,585 | A | 10/1983 | Quinn |
| 4,422,819 | A | 12/1983 | Guest |
| 4,692,089 | A | 9/1987 | Rodgers et al. |
| 5,071,311 | A | 12/1991 | Foster et al. |
| 5,688,102 | A | 11/1997 | Vieselmeyer |

*Primary Examiner*—Donald W. Underwood
(74) *Attorney, Agent, or Firm*—Beyer Weaver & Thomas LLP

(57) ABSTRACT

A load bearing lift attachment apparatus for a multipurpose loader bucket including a first jaw and a second jaw movably mounted thereto between an opened condition and a closed condition. The lift attachment apparatus includes a lift member formed and dimensioned to engage an object to be lifted; and a lift support device removably coupling the lift member to the loader bucket. The lift support device is configured to cooperate with the first jaw, and the top surface and the bottom surface of the engaging wall of the second jaw, in the closed condition, to distribute the cantilever forces, caused by the weight of the object acting on the loader bucket, across a substantial transverse portion of a support member of the first jaw and a engaging wall of the second jaw.

15 Claims, 9 Drawing Sheets

LOAD BEARING ATTACHMENT APPARATUS FOR A MULTIPURPOSE LOADER BUCKET

RELATED APPLICATION

This application is a Continuation-In-Part application based upon patent application Ser. No. 09/396,302, filed Sep. 15, 1999, and entitled LOAD BEARING LIFT ATTACHMENT APPARATUS FOR A MULTIPURPOSE LOADER BUCKET, now U.S. Pat. No. 6,287,070.

TECHNICAL FIELD

The present invention relates, generally, to lift attachments, and, more particularly, to load bearing attachments mounted to multipurpose loader buckets for earth moving equipment.

BACKGROUND OF THE INVENTION

Heavy earth moving equipment typically includes multipurpose loader buckets or backhoes which are well adept for moving and hauling sand, gravel, landfill or the like. Due to their versatility, speed and loading capacity, these front-end loaders are especially suitable for construction, excavation and agricultural applications. Typically, a tractor or the like is fitted with a pair of hydraulically driven lift arms which raise, lower and pivot the multi-purpose bucket for earth moving use.

While these front-end loaders are quite versatile to perform multiple earth moving functions, these buckets are inadequate for moving bulky or elongated items which are unable to fit therein such as large rocks, beams and pipes. Often, a separate forklift vehicle must be employed to perform these hauling tasks. This of course substantially adds to construction costs, as well as consumes space.

As a result, various implements have been developed which adapt these buckets for forklift use. Such adaptations not only increase the versatility of the front-end loaders, but they eliminate the cost and burden associated with the use of separate forklift vehicles. These implements generally include two or more forklift members fixedly spaced-apart from one another, and removably mounted to a lower support member of the front-end loader bucket. Usually, these forklift members extend under the loader bucket support member for structural mounting thereto, while a clamping assembly is employed to releasably clamp the forklift members to a leading edge portion of the support member. A rear portion of each forklift member is then mounted to an upper rear portion of the loader bucket for stability. Typical of these patented designs are disclosed in U.S. Pat. Nos.: 4,411,585; 4,242,035; 4,125,952 and 3,706,388.

While these forklift implements are adequate for hauling and carrying relatively low to middle weight items (i.e., under 10,000 lbs), the lifting of heavy weight objects may cause severe damage to the implement and/or the loader bucket. Due to the extreme cantilever forces concentrated at contact points along the leading edge of the lip portion, the clamping assembly of the implement and/or the lip portion of the bucket leading edge may be caused to irreparably bend or deform during heavy weight use. Consequently, repair or replacement costs can be substantial.

Other forklift implements have been developed which are primarily supported atop the support member of the loader bucket. However, these designs similarly fail to distribute the cantilever forces across the loader bucket. During heavy load use, the extreme cantilever forces are also concentrated at contact points along the leading edge of the lip portion. Typical of these patented structures are disclosed in U.S. Pat. Nos.: 4,329,103 and 3,667,633.

Thus, a forklift implement for use with a front-end loader is desirable which can accommodate relatively heavy weights without damaging the loader bucket and/or the implement.

SUMMARY OF THE INVENTION

To achieve the foregoing, the present invention relates to a load bearing lift attachment apparatus for a multipurpose loader bucket. A first jaw of the loader bucket is movably mounted to a second jaw thereof between an opened condition and a closed condition. The first jaw includes a support member transversely extending from one side to an opposite side of the loader bucket. A front portion of the loader bucket terminates at a transversely extending leading edge, while an opposite rear portion thereof terminates at a rear edge. The second jaw includes an engaging wall transversely extending from the loader bucket one side to the opposite side thereof. The engaging wall further terminates at an engaging edge, and is formed to engage the rear portion of the jaw support member in the closed condition. The lift attachment apparatus of the present invention includes a lift member formed and dimensioned to engage an object to be lifted; and a support device removably coupling the lift member to the loader bucket. The support device includes a load bearing member formed to extend transversely across an upper surface of the first jaw support member for support thereatop. An elongated rear coupling member is sized and structured to simultaneously engage the rear portion of the support member of the first jaw, and the top surface and the bottom surface of the engaging wall of the second jaw, in the closed condition, to distribute the cantilever forces, caused by the weight of the object acting on the loader bucket, across a substantial transverse portion of the support member of the first jaw and the engaging wall of the second jaw.

In one configuration, the elongated rear coupling member includes an alignment lip in abutting contact with the bottom surface of the engaging wall of the second jaw for supportive alignment thereof, when in the closed condition. The elongated rear coupling member further includes a contacting portion having a forward surface and an opposed rearward surface. Each surface extends transversely across a substantial portion of the rear edge of the first jaw support member. The forward surface is in abutting contact with the rear edge, and the rearward surface is in abutting contact with the engaging edge of the engaging wall, for supportive alignment therebetween, when the loader bucket is in the closed condition.

The rear coupling member further includes a lower lip portion extending rearwardly from the rearward surface of the contacting portion, to a position under the bottom surface of the engaging wall. The alignment lip extends upwardly from the lower lip portion, toward the bottom surface of the engaging wall, for the abutting contact therewith.

In another embodiment, the lift member includes an elongated forklift prong portion extending forwardly of the load bearing member. The lift member includes a track assembly slideably mounting the lift member to the load bearing member to facilitate sliding displacement of the lift member laterally therealong. Preferably, the track assembly includes a support rod extending longitudinally across and substantially parallel to the rear coupling member. The lift member includes a receiving passage formed and dimensioned for sliding receipt of the rod longitudinally therethrough for sliding lateral displacement of the lift member laterally along the load bearing member portion.

BRIEF DESCRIPTION OF THE DRAWINGS

The method and assembly of the present invention has other objects and features of advantage which will be more readily apparent from the following description of the Detailed Description of the Embodiments and the appended claims, when taken in conjunction with the accompanying drawing, in which:

DETAILED DESCRIPTION OF THE EMBODIMENTS

Figure 1:
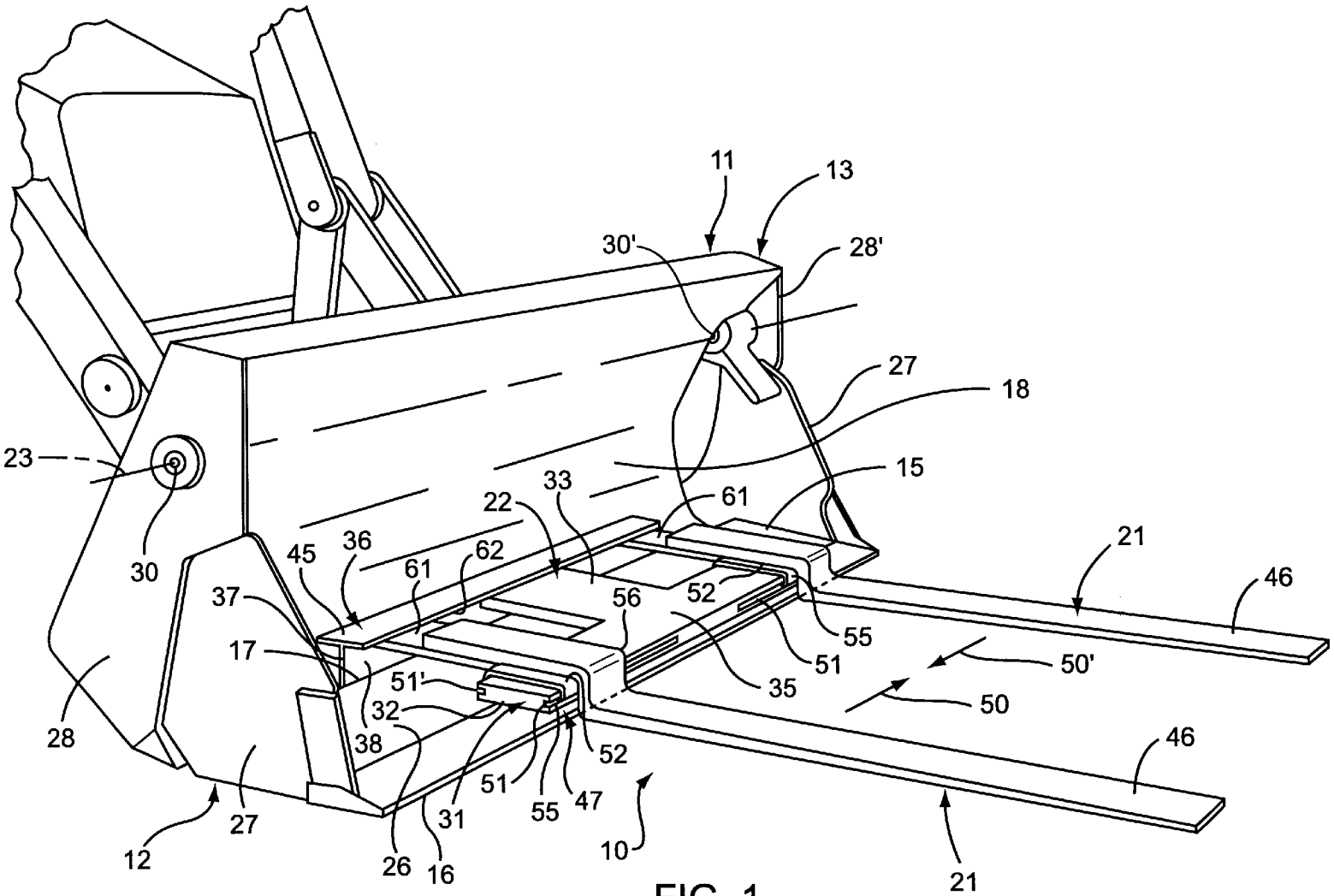
FIG. 1 is a top perspective view of a lift attachment apparatus constructed in accordance with the present invention and mounted to a loader bucket of a tractor vehicle.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
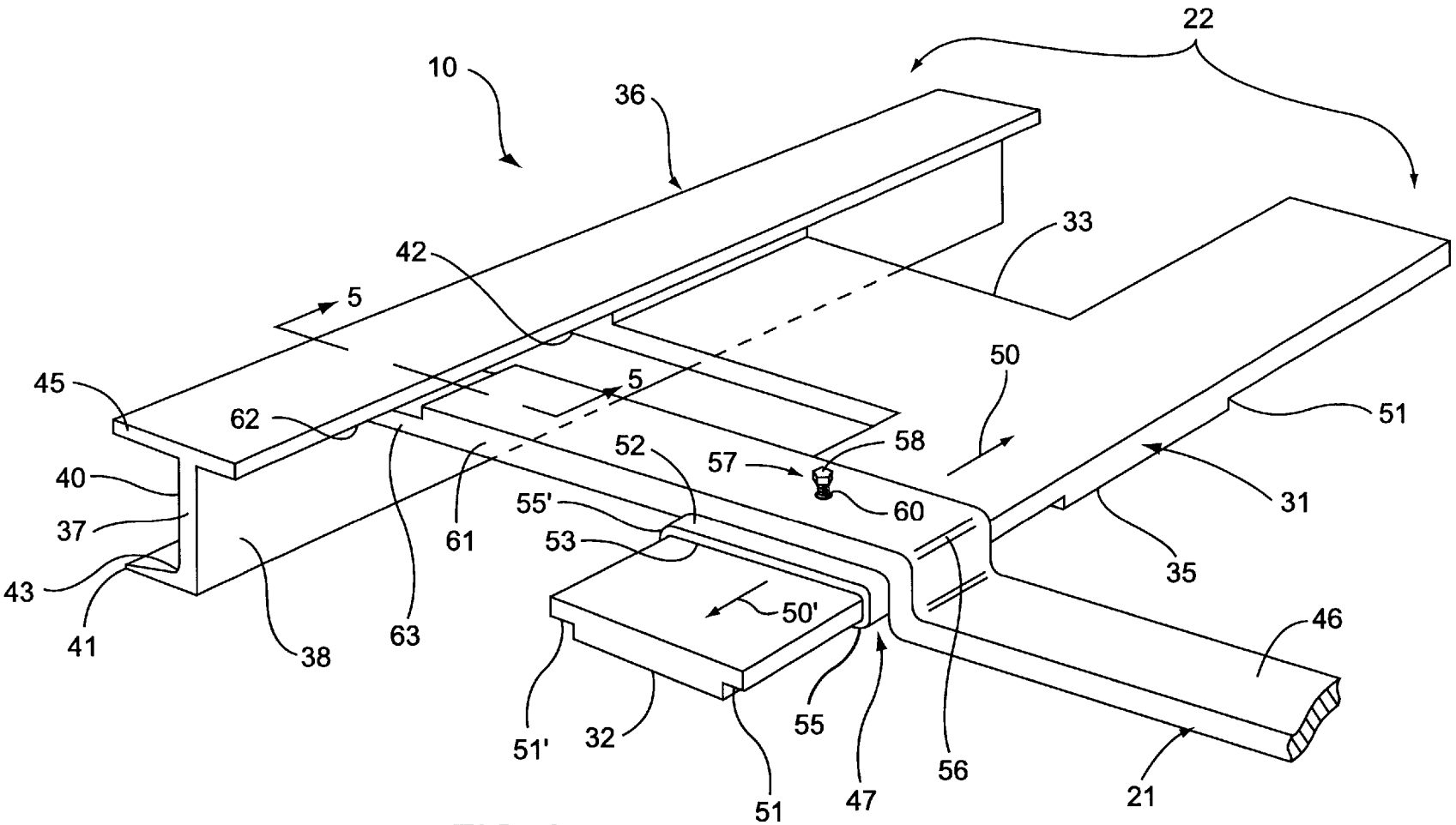
FIG. 2 is an enlarged front perspective view of a load bearing member of the lift attachment apparatus of FIG. 1.
Figure 5:
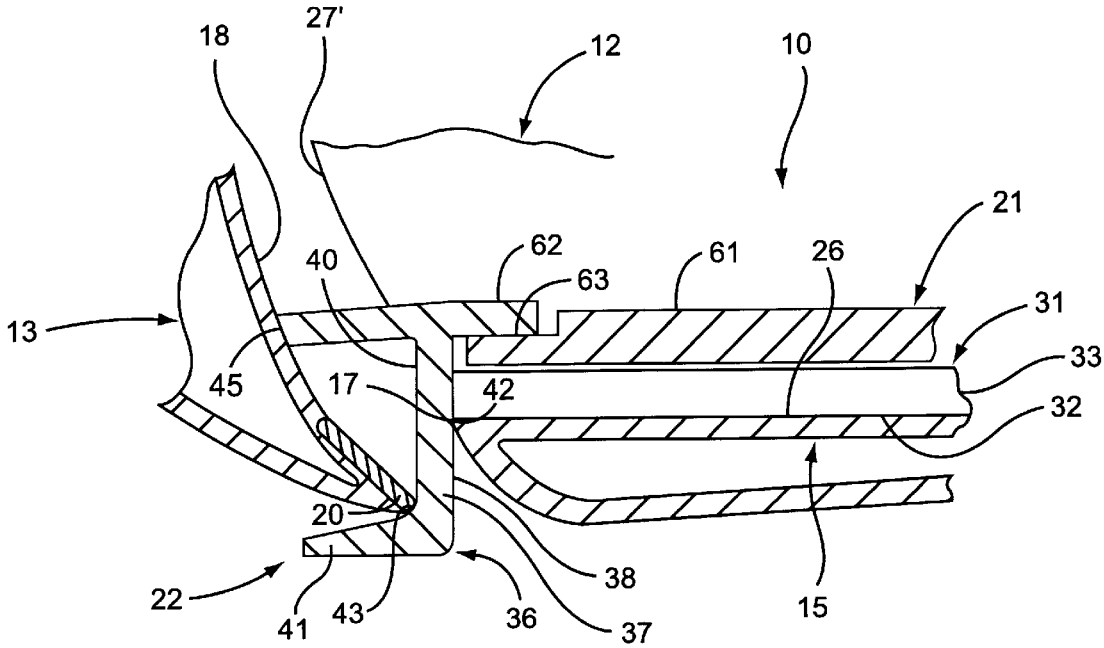
FIG. 5 is an enlarged, fragmentary, side perspective view, in cross-section, of the lift attachment apparatus taken substantially along the plane of the line 5-5 in FIG. 2, and illustrating the load bearing member engaged with the first and second jaw portions of the loader bucket in the "closed" condition.
Figure 4:
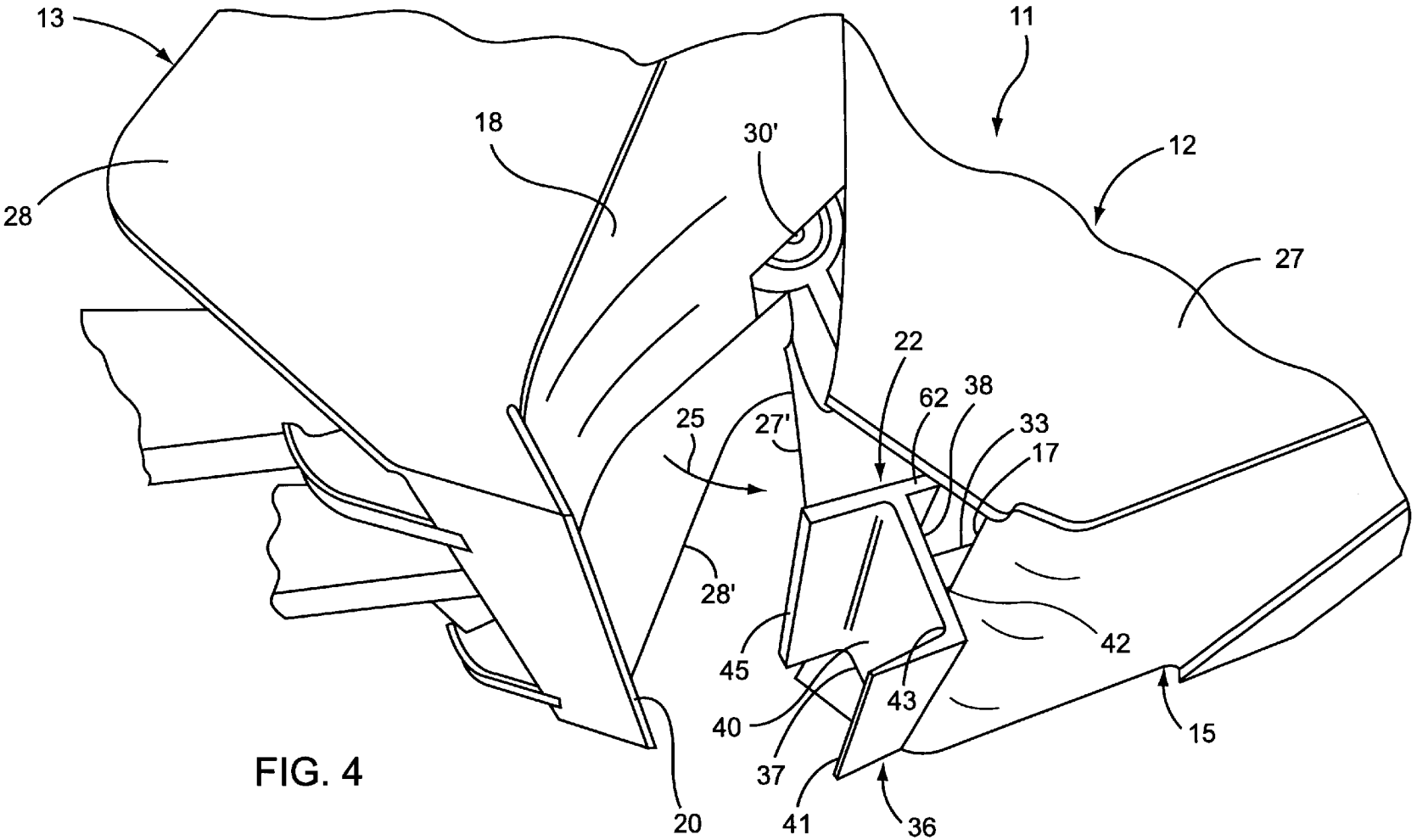
FIG. 4 is an enlarged, fragmentary bottom perspective view of the load bearing member of the lift attachment apparatus supported atop the first jaw of the loader bucket, in an "opened" condition.

Referring now to FIGS. 1, 2 and 4, a load bearing lift attachment apparatus, generally designated 10, is illustrated for a multipurpose loader bucket 11. The loader bucket 11 includes a first jaw 12 which is movably mounted to a second jaw 13 thereof between an opened condition (FIG. 4) and a closed condition (FIGS. 1 and 5). The first jaw 12 includes a lower support member 15 transversely extending from one side to an opposite side of the loader bucket 11. A front portion of the support member 15 terminates at a transversely extending leading edge 16, while an opposite rear portion thereof terminates at a rear edge 17. The second jaw 13 includes a rear engaging wall 18 transversely extending from the loader bucket 11 one side to the opposite side thereof. The engaging wall 18 further terminates at an engaging edge 20, and is formed to engage the rear portion of the first jaw support member 15 in the closed condition. The lift attachment apparatus of the present invention includes a lift member 21 formed and dimensioned to engage an object to be lifted; and a support device, generally designated 22, removably coupling the lift member 21 to the loader bucket 11. The support device 22 is configured to cooperate with the first jaw 12 and the second jaw 13, in the closed condition, to distribute the cantilever forces, caused by the weight of the object acting on the loader bucket, across a substantial transverse portion of the support member 15 of the first jaw 12 and the engaging wall 18 of the second jaw.

Accordingly, the present invention provides a lift support device for a loader bucket which enables the lift member to supportively lift relatively heavyweight components through operation and movement of the loader bucket. This is performed without damaging the loader bucket, and/or the lift support device by mounting the support device to the loader bucket in a manner which distributes the cantilever forces, caused by the weight of the heavyweight components, throughout a large transverse region of the loader bucket. Thus, high concentrations of force at the contacting regions, which may cause localized bending and deformation of the loader bucket, may be eliminated.

Referring back to FIG. 1, it will be appreciated that the lift attachment apparatus 10 of the present invention is best suited for mounting to a backhoe-type loader bucket having a lower first jaw 12 and a rear second jaw 13 pivotally mounted to the first jaw around pivot axis 23 (in phantom lines). Briefly, this backhoe loader bucket is pivotally movable from an "opened" condition (FIG. 4) to a "closed" condition (FIGS. 1 and 5). In the opened condition, the backhoe loader bucket is typically employed to perform the tasks of grading. However, in accordance with the present invention and as will be described in greater detail below, the "opened" condition of the loader bucket 11 enables premounting of the lift attachment apparatus thereto. Upon pivotal movement of the first and second jaws toward the "closed" condition (as represented by arrow 25 in FIG. 4), the jaws simultaneously engage the attachment apparatus 10 (FIG. 5). It will be further understood that the term "closed" condition in the present application is referred to as the cooperative mounting engagement of the first and second jaws with the attachment apparatus for retentive mounting thereto. Thus, due to the simultaneous engagement with the support device 22, the first and second jaws of the loader bucket will not be capable of full movement a fully "closed" position when the support device is removed.

The lower first jaw 12 includes a relatively rectangular-shaped lower support member 15 extending from one side of the loader bucket 11 to an opposite side thereof. The support member defines a generally planar upper surface 26 upon which the lift attachment apparatus is supportively seated. The upper surface 26 terminates at a relatively linear front leading edge 16, at the front portion of the support member, and an opposed, relatively linear rear edge 17 at the rear portion thereof. Rigidly upstanding from the opposed sides of the lower support member 15 are a pair of side walls 27, 27'. These, in turn, are pivotally mounted to corresponding opposed side walls 28, 28' of the second jaw 13 at pivot points 30, 30', respectively. As shown in FIGS. 1, 4 and 5, the rearward second jaw 13 of the loader bucket 11 includes a rear engaging wall 18, coupled between the opposed side walls 28, 28', which terminates at a lower engaging edge 20. In the "closed" condition, the engaging edge 20 of the second jaw 13 will be positioned substantially parallel and proximate to the rear edge 17 of the first jaw 12.

When the engaging edge 20 and the engaging wall 18 of the second jaw 13 engage the attachment apparatus 10, in the "closed" condition (FIG. 5), the attachment apparatus of the present invention supportively cooperates with both the first jaw 12 and the second jaw 13 for mounting support of the attachment apparatus thereto. Consequently, during the lifting operation, the transverse engagement of the first jaw support member 15 with the front portion of the lift support device 22, and of the simultaneous transverse engagement between the lift support device 22 with the rear portion of the support member 15 and with the engaging wall of the second jaw 13, causes the cantilever forces caused to be distributed across a large transverse region of the loader bucket 11.

Figure 3:
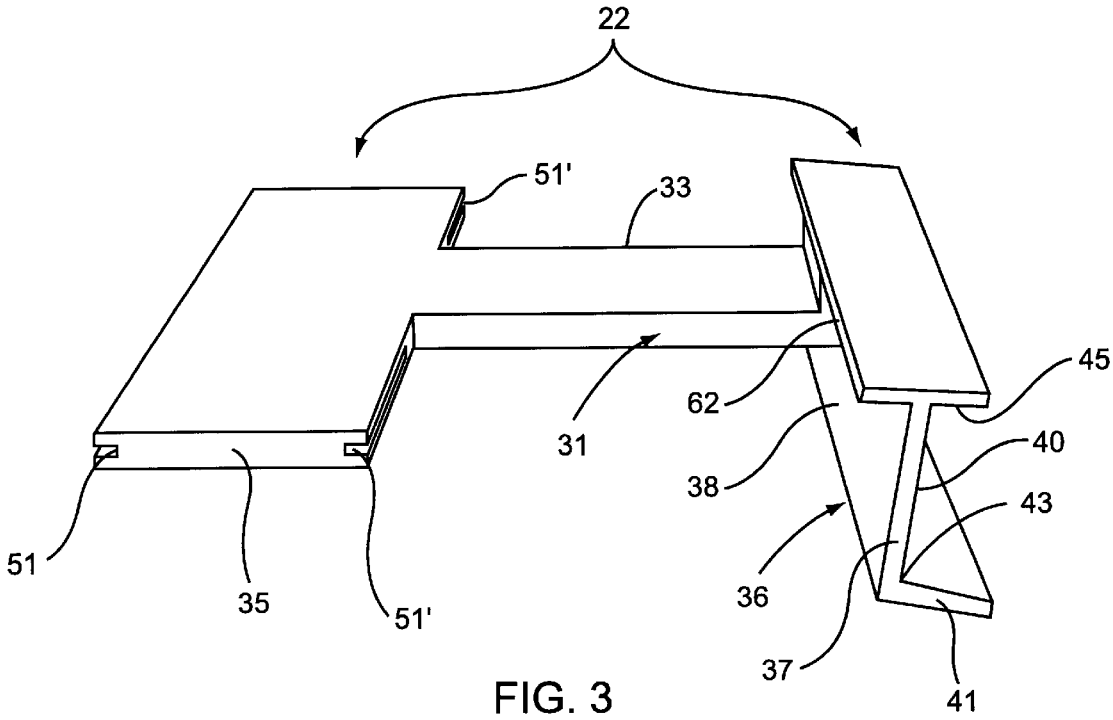
FIG. 3 is a side perspective view of the load bearing member of FIG. 2.

As best viewed in FIGS. 1–3, the support device 22 of the attachment apparatus 10 preferably includes a plate-like load bearing member 31 which is adapted to transfer these cantilever forces to the loader bucket 11. The load bearing member 31 is preferably composed of a rigid material capable of withstanding high shear load forces. For example, the load bearing member may be composed of a metallic material, such as a steel plate having a thickness between about ½ inch to about 1 inch. Other various thickness metallic materials may be employed of course.

The load bearing member preferably provides a substantially planar lower surface 32, or one which is shaped to generally conform to the contour of the upper surface 26 of the first jaw support member 15. In this manner, the area of supportive contact between the load bearing member 31 and the support member 15 of the first jaw 12 can be maximized in an effort to distribute the cantilever forces transversely thereacross. Consequently, this proportionately larger contact area, relative the transverse dimension of the support member, enables a greater collective lift capacity of the attachment apparatus 10 while maintaining the structural integrity of the loader bucket 11.

The load bearing member 31 is preferably T-shaped having an elongated body portion 33 and a transverse wing portion 35 extending outwardly therefrom. This winged section is configured to extend transversely across a substantial portion of the support member 15, and preferably seats proximate to the support member leading edge 16 of the front portion thereof. As best illustrated in FIGS. 1 and 2, this wing portion 35 is further adapted to slidably support one or more of the lift members 21 thereon. Thus, when the lift members are supporting the weight of an object lifted (not shown), the downward components of the cantilever forces acting upon the wing portion 35 of the attachment apparatus 10 are distributed across a substantial transverse portion of the loader bucket support member 15.

As above-indicated, the width of the wing portion 35 must extends across a substantial transverse portion of the upper surface 26 to assure a sufficient transverse distribution of forces across the support member 15 of the loader bucket 11. Thus, while the structural integrity of the loader bucket 11 depends upon many factors, such as the composition, the structural design and the thickness of the bucket, it is important to configure the width dimension of the wing portion 35 to be at least about one-half the transverse dimension of the first jaw support member 15. Similarly, the depth dimension of the wing portion is preferably at least about one-quarter the depth of the support member 15 extending from the front leading edge 16 to the rear edge 17 thereof.

Preferably, the body portion 33 extends generally perpendicular to a central region of the wing portion 35 and in a direction from the front portion of the first jaw support member 15 to the rear portion thereof. The lift support device 22 of the present invention includes a rear coupling member, generally designated 36, rigidly mounted to a distal rear end of the body portion 33 which is adapted to simultaneously engage a rear portion of the support member 15 and the engaging wall 18 of the second jaw 13 (FIG. 5). Consequently, during lifting by the lift members 21, this simultaneous engagement transversely distributes the upward components of the cantilever forces acting upon the rear coupling member 36 substantially across the rear transverse portion of the support member 15, the engaging wall 18 and the engaging edge 20 of the second jaw 13.

FIGS. 2 and 3 illustrate that the rear coupling member 36 includes a plate-like contacting portion 37 extending substantially transverse to the elongated body portion 33, and generally parallel to the wing portion 35 of the load learning member 31. The contacting portion 37 is rigidly mounted to the body portion 33 of the load bearing member 31, and includes a forward facing surface 38 and an opposed rearward facing surface 40. In the "opened" condition of the loader bucket 11, as best viewed in FIG. 4, when the lift support device 22 is initially predisposed atop the first jaw support member 15 (not shown), the off-set of the contracting portion 37 which is caused by the lower lip portion 41 will prevent supportive contact between the lower surface 32 of the load bearing member 31 and the upper surface of the first jaw support member 15. However, upon further rearward displacement of the lift support device 22 relative the first jaw 12, the forward surface 38 of the rear coupling member 36 is moved just beyond the rear edge 17 of the first jaw support member. This enables the body portion 33 to drop down into supportive contact with the upper surface 26 of the support member 15 for support thereof.

Briefly, one technique to mount the lift support device 22 to the first jaw 12 would be to mount one end of a chain or the like to the support device near its center of gravity (not shown). By tautly coupling the opposite end of the chain over the top of the second jaw 13, the loader bucket may be rotated and moved upward to lift the rear coupling member 36 until it drops down past the rear edge 17 of the first jaw support member 15.

In the preferred form, the forward surface 38 of the contacting portion 37 extends transversely across and substantially parallel to a substantial transverse portion of the rear edge 17 of the first jaw support member 15. Accordingly, the forward surface 38 is preferably substantially planar, and is formed for abutting contact with the rear edge 17 of the first jaw 12. As best shown in FIG. 5, a front intersection crease 42 is formed between the forward surface 38 of the contacting portion 37 and the lower surface 32 of the body portion 33. This crease 42 preferably extends continuously along the transverse dimension of the body portion 33 and is adapted to receive and supportively seat against the rear edge 17 of the first jaw support member 15. Upon seated receipt, the wing portion 35 of the load bearing member 31 will be supportively aligned proximate and substantially parallel to the leading edge 16 of the support member 15.

In the preferred embodiment, the angle formed between the forward surface 38 of the rear coupling member 36 and the lower surface 32 of the load bearing member 31 is slightly acute (FIGS. 3 and 5). Once the forward surface 38 is moved past the rear edge 17 of the first jaw support member 15, this slightly angled configuration facilitates seating of the rear edge 17 into the front intersection crease 42. While this intersecting angle can be about 90° of even slightly obtuse, this angle is preferably in the range of about 80° to about 85°.

In accordance with the present invention, the rear coupling member 36 further includes a lower lip portion 41 extending rearwardly from the rearward surface 40 of the contacting portion 37. At an intersection between the lower lip portion 41 and the rearward surface 40 of the contacting portion 37 is a rear intersection crease 43 which extends continuously from one end of the rear coupling member 36 to an opposite end thereof. The orientation and location of this rear intersection crease 43 is positioned and oriented, relative the front intersection crease 42, such that when the loader bucket 11 is moved to the closed condition, the engaging edge 20 of the second jaw engaging wall 18 substantially seats in this rear intersection crease. Such engaging contact maintains the rear portion of the load bearing member 31 against the rear portion of the first jaw support member 15, as well as maintains the rear edge 17 of the support member seated in the front intersection crease 42 of the load bearing member 31. Hence, when the upward component of the cantilever forces are urged upon the rear portion of the lift support device 22 during loading, this engaging contact counteracts these force components to enable stabilized lifting by the lift attachment apparatus 10.

In a further aspect of the present invention, the rear coupling member 36 includes an upper lip portion 45 extending rearwardly from the rearward surface 40 of the contacting portion 37. As best viewed in FIG. 5, the upper lip portion 45 is formed and dimensioned to supportively seat against the engaging wall 18 when the loader bucket 11 is in the "closed" condition. Similar to the lower lip portion 41, the upper lip portion preferably extends continuously from one side of the coupling member to the other side thereof. It will be appreciated, however, that either the upper lip portion 45 and the lower lip portion 41 may be segmented across the rear coupling member 36 without departing from the true spirit and nature of the present invention.

During pivotal movement of the second jaw 13 in the direction of arrow 25 (FIG. 4), the engaging wall 18 of the second jaw 13 engages the distal end of the upper lip portion 45 as the engaging edge of the second jaw 13 seats into the rear intersection crease 43. As set forth above, this simultaneously engagement urges the rear edge 17 of the first jaw support member 15 into the front intersection crease 42 of the load bearing member 31. Accordingly, as shown in FIGS. 1 and 5, the engagement of the engaging edge 20 with the rear coupling member retains the lift support device downwardly against the first jaw support member, while the engagement of the engaging wall 18 with the distal end of the upper lip portion 45 retains the rear coupling member 36 forwardly against the rear edge 17 of the first jaw support member.

Referring now to FIGS. 1, 2, 6 and 7, the lift member 21 is preferably provided by a pair of forklift prongs. These elongated structures each include a lifting end 46 configured for extension under the object and for vertical lifting of the object in a conventional forklift operation manner. At an opposed mounting end of each forklift prong 21 is a mounting device 47 formed to removably mount to a respective wing portion 35 of the load bearing member 31. More preferably, each mounting device 47 cooperates with the respective wing portion 35 to removably mount the forklift prong at one of a plurality of positions therealong. This accordingly enables selective lateral spacing of the two forklift prongs 21 therebetween. Such adjustability is especially beneficial in stances where palets are made in different widths.

In the preferred embodiment, the mounting device 47 includes a track assembly positioned between the forklift prong 21 and the wing portion 35 for slidable positioning of the forklift prong at any one of the plurality of positions along the wing portion. As shown in FIG. 2, at least one of the forklift prongs 21 (only one of which is shown) can be slidably displaced in the direction of arrows 50, 50' for relative lateral displacement therebetween.

The track assembly preferably includes a pair of opposed elongated slots or grooves 51, 51' extending along the opposed side walls of each wing portion 35, respectively. In one embodiment (FIGS. 1 and 3), the elongated slots 51, 51' may be disposed central to the opposed side walls of the respective wing portion 35, and extend from the distal ends thereof inwardly toward the body portion 33 of the load bearing member 31. Alternatively, as viewed in FIG. 2, each elongated slot 51, 51' may be defined along the lower edge portions at the intersection edges of the lower surface 32 and the side walls.

To slidably mount the forklift prong 21 to the respective wing portion 35, the track assembly includes a sleeve device 52 mounted to the underside of forklift prong. Each sleeve device 52 defines a rectangular shaped passage 53 (FIGS. 6 and 7) formed and dimensioned for relatively snug sliding receipt of the respective wing portion 35 therethrough. By reducing the tolerance between the components, the forklift prong can slide relatively unrestrained along the wing portion 35 while providing substantial stability thereof during the lifting operation. As best viewed in FIGS. 6 and 7, each sleeve device 52 includes a pair of elongated finger portions 55, 55' extending the lateral length of the passage 53, and which are formed for sliding inter-engagement with a respective elongated slot 51, 51'. As the sleeve device slidable receives the cross-sectional dimension of the wing portion 35, the finger portions 55, 55' slidably engage the elongated slot 51, 51' for aligned sliding movement of prong therealong.

Figure 7:
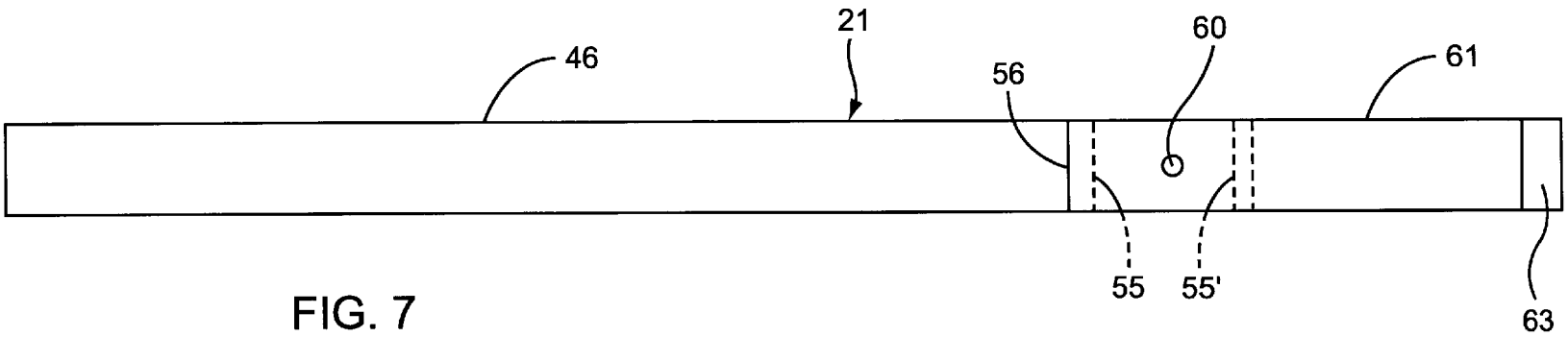
FIG. 7 is a top plan view of the forklift prong of FIG. 6.
Figure 6:
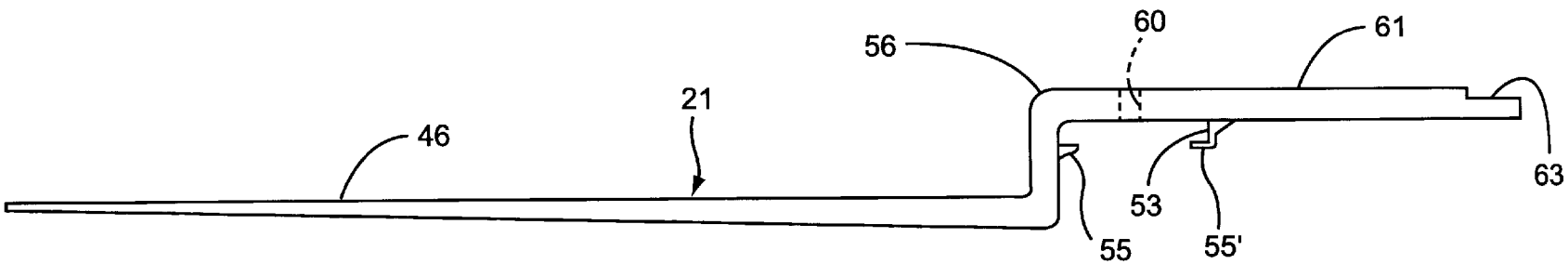
FIG. 6 is an enlarged side elevation view of a forklift prong for the lift attachment apparatus of the present invention.

Referring to FIGS. 6 and 7, it is shown that the passage 53 of the sleeve device 52 may be partially formed by the underside of the upper knee portion 56 of the forklift prong 21. The elongated finger portions 55, 55' may then be formed by simple protrusions, either welded or cast, into the underside of the forklift prong. In other embodiments, the sleeve device 52 may be formed by mounting an independent sleeve device to the underside of the forklift prong, as illustrated in FIGS. 1 and 2.

While the present invention is preferably illustrated with the elongated slots 51, 51' formed in the side walls of the wing portions 35, it will be appreciated that the elongated slots may be defined by the sleeve device itself while the finger portions could be defined by the wing portions without departing from the true spirit and nature of the present invention. Moreover, it is apparent from the embodiment of FIG. 2 that the elongated slots 51, 51' could be oriented at the lower intersecting edge between the lower surface 32 and the opposed side walls of the wing portion 35. Further, the receiving passage 53 of the sleeve device 52 may be widened such that the finger portions 55, 55' simply slide under the lower surface 32 of the wing portions (not shown), thereby eliminating the need for any elongated slots. This configuration may be applied in instances where the wing portion may be seated atop a plurality of laterally spaced-apart bolts (common in some loader bucket designs) positioned across the first jaw support member.

To releasably secure the forklift prong 21 at one of the plurality of positions along the track assembly, a lock device 57 may be provided. This lock device 57, as shown in FIGS. 1, 6 and 7, releasably retains the forklift prong 21 against the wing portion 35 to prevent relative sliding movement therebetween. In the preferred form, the lock device 57 includes a threaded lock screw 58 which cooperates with a threaded aperture 60 extending through the forklift prong 21 to releasably engage the wing portion 35. Once the forklift prong 21 is properly positioned along the wing portion 35, the lock screw may be moved into engagement with the top surface of the wing portion 35 to releasably retain the prong in place. Release of the lock screw 58 will subsequently disengage the screw with the wing portion to enable relative sliding displacement.

In accordance with the present invention, each forklift prong 21 further includes a stabilizing member 61 to further stabilize the respective prong relative the lift support device 22. As best shown in FIGS. 1 and 2, the stabilizing member 61 extends rearwardly from the track assembly and wing portion 35 to cooperatively engage the rear coupling member 36 for stabilization thereof. Such cooperative engagement facilitates the distribution of the cantilever forces between the wing portion 35 and the rear coupling member 36 of the lift support device 22. Without the stabilizing member 61, the track assembly would be required to accommodate the full cantilever loads which, consequently, would require substantial reinforcement between the track assembly finger portions 55, 55' and the respective elongated slots 51, 51'.

Preferably, the rear coupling member 36 includes a stabilizing ledge 62 extending forwardly from a top portion of the forward surface 38 of the contacting portion 37. This ledge enables sliding engagement with the forklift prong stabilizing member 61. During lifting operation, however, a portion of the upward components of the cantilever forces are transmitted through the stabilizing member 61 to the stabilizing ledge 62, and subsequently distributed through the rear portion of the first jaw support member 15 and the engaging wall 18 of the second jaw.

As best viewed in FIG. 6, the stabilizing member 61 includes a distal lip portion 63 adapted to slidably engage the underside of the stabilizing ledge 62 of the rear coupling member. Upon operational lifting, however, the distal lip portion 63 vertically engages the stabilizing ledge 62 to transfer the upward component of the load.

Figure 8:
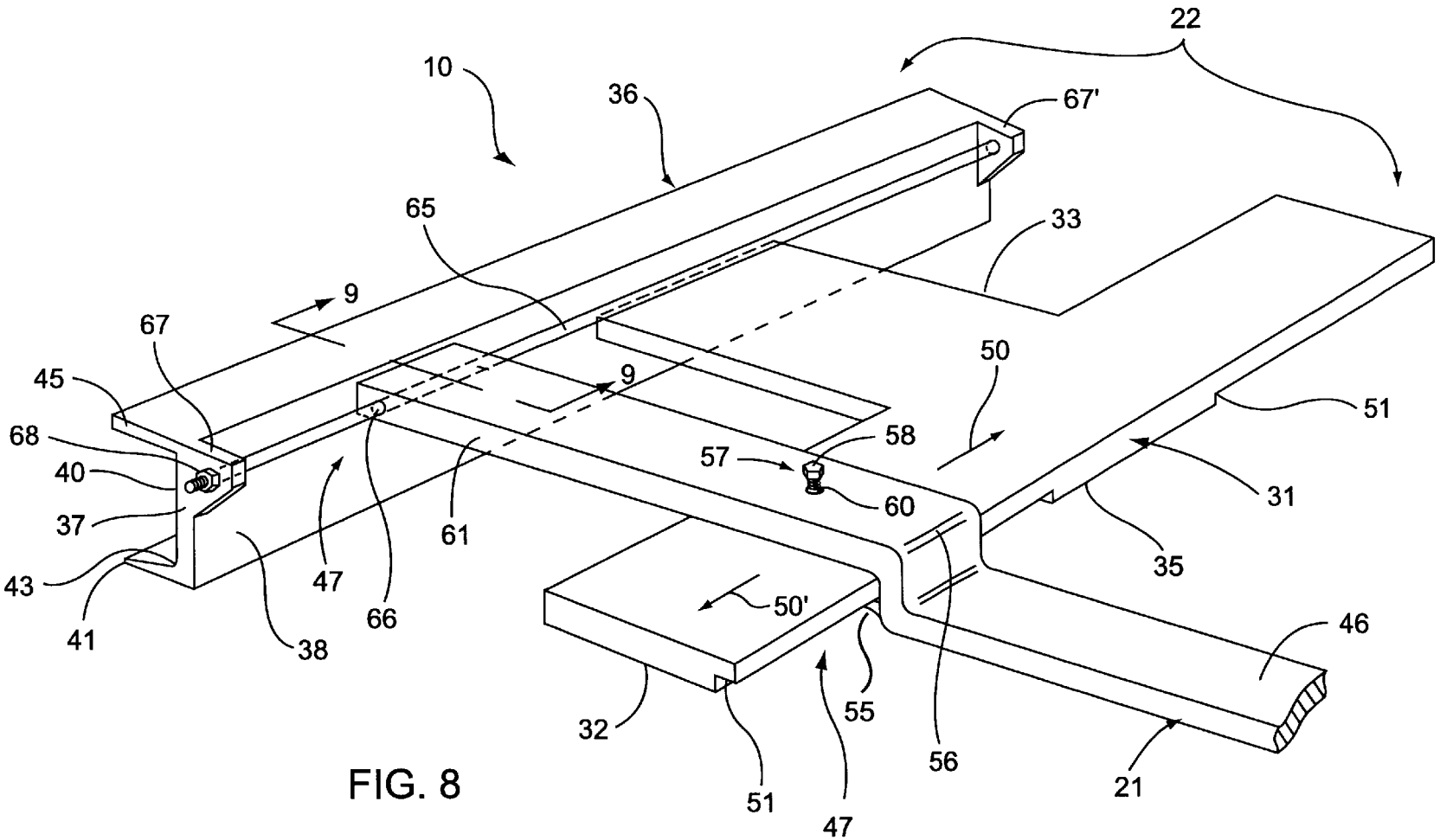
FIG. 8 is an enlarged front perspective view of the lift attachment apparatus of the present invention incorporating a rear slide rod to facilitate lateral displacement of the forklift prong therealong.
Figure 9:
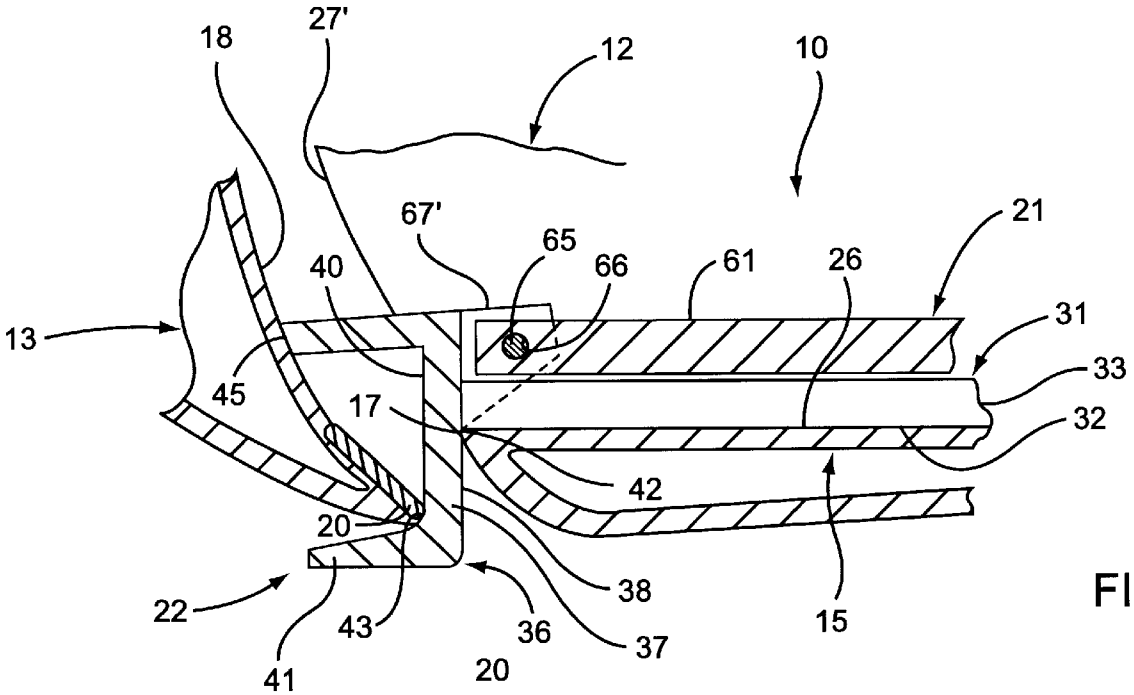
FIG. 9 is an enlarged, fragmentary, side perspective view, in cross-section, of the lift attachment apparatus taken substantially along the plane of the line 9—9 in FIG. 8, and illustrating the load bearing member engaged with the first and second jaw portions of the loader bucket in the "closed" condition.

Referring now to FIG. 8, to facilitate sliding displacement of the forklift prongs 21 (only one of which is illustrated) laterally along the support device 22 of the lift attachment apparatus 10, the track assembly of the mounting device 47 may include a support rod, generally designated 65, at the rear coupling member 36 which slideably supports the prong. The elongated support rod 65 is preferably mounted to the contact portion 37 at a substantially horizontal orientation and substantially parallel to the forward facing surface 38. The stabilizing member 61 includes a receiving passage 66 (FIGS. 9and 10) extending therethrough which is formed and dimensioned for sliding receipt of the support rod longitudinally therethrough to enable selective lateral displacement of the forklift prong 21 in the directions of arrows 50, 50'. Accordingly, in this configuration, the support rod 65 not only enables sliding lateral displacement, but also transfers the upward component of the cantilever loads to the rear coupling member 36.

As best viewed in FIG. 8, support rod 65 is rigidly coupled to the contact portion 37 of the rear coupling member 36 through a pair of spaced-apart mounting flanges 67, 67' forwardly extending from the forward facing surface 38. These mounting flanges 67, 67' are rigidly mounted to of the contacting portion 37 preferably at opposed ends thereof so that the loads can be distributed and transferred to the coupling member 36.

To enable mounting of the forklift prongs 21 to the support device 22, the support rod 65 may be removably mounted to the mounting flanges 67, 67' through apertures (not shown) extending laterally therethrough. Once the support rod 65 is longitudinally positioned through the flange apertures and the receiving passage 66 of the prong stabilizer member 61, fasteners 68, preferably in the form of bolts, may be applied to the ends of the rod to secure the rod to the flanges.

The elongated support rod 65 is preferably circular in the transverse cross-section, and is composed of a high strength metallic material. Preferably, the rod is steel having a diameter of between about one (1) inch to about one and one-half (1½) inch. It will be appreciated, however, that the transverse cross-sectional dimension of the rod may be any geometric shape. Further, the receiving passage 66 extending through the stabilizing member 61 of the forklift prong 21 must be sufficiently larger than the diameter of the support rod 65 to enable sliding displacement therealong. However, the tolerance must not be so large as to cause undue movement of the rod either longitudinally therethrough or laterally in the passage. For example, for a 1–1½ inch diameter rod, the diameter of the passage 66 is preferably about 1¼–1¾ inch, respectively.

Figure 10:
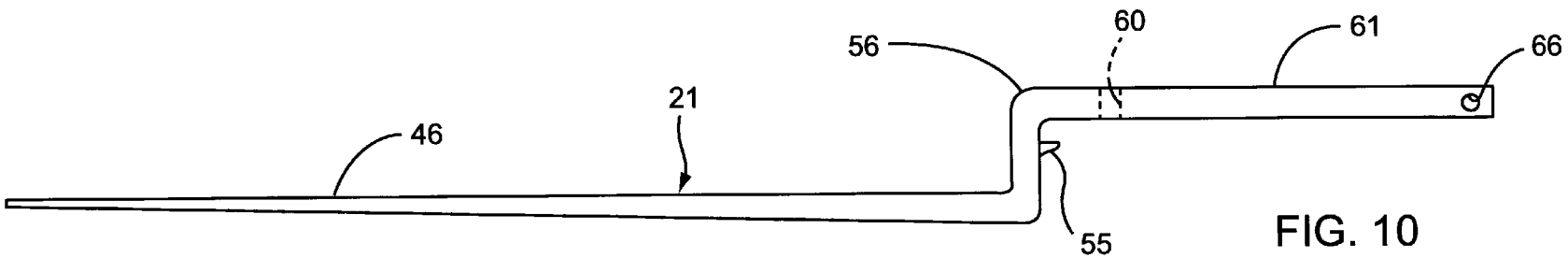
FIG. 10 is an enlarged side elevation view of a forklift prong for the lift attachment apparatus of FIG. 8.

In this embodiment, as shown in FIG. 10, the track assembly may only require one finger portion 55 extending from the forklift prong 21 for sliding engagement with the elongated slot 51 of the wing portion 35. Due to the stabilized mounting of the stabilizer member 61 of the forklift prong 21 to the support rod, an opposed finger portion and corresponding elongated slot may be unnecessary. Moreover, the forklift prong 21 may include a threaded aperture 60 formed for receipt of a lock screw 58 of the lock device 57 (FIG. 8) therethrough to releasably secure the forklift prong 21 to the wing portion 35.

Figure 11:
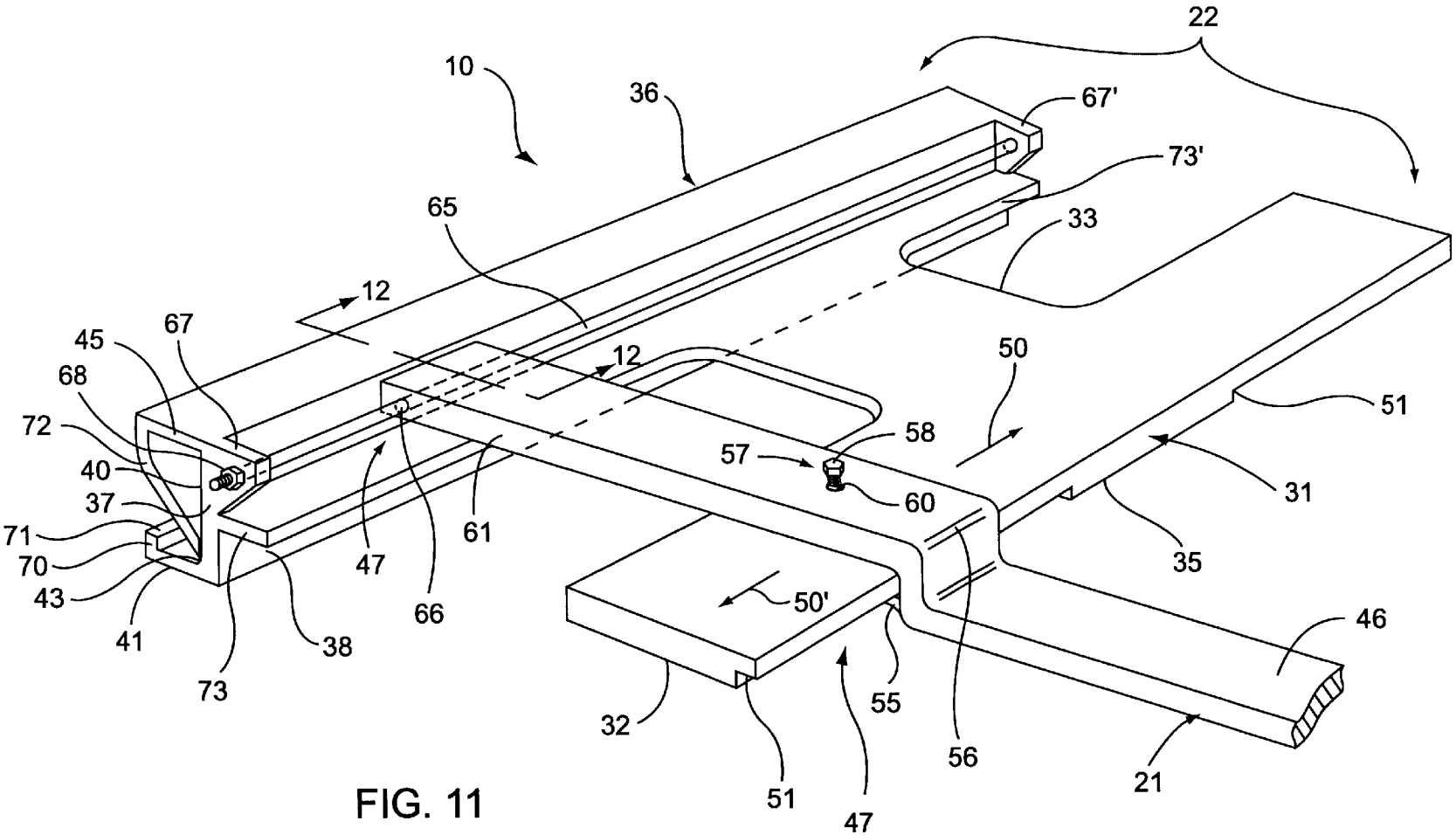
FIG. 11 is an enlarged front perspective view of an alternative embodiment lift attachment apparatus incorporating an alignment lip to facilitate supportive alignment with the loader bucket.
Figure 12:
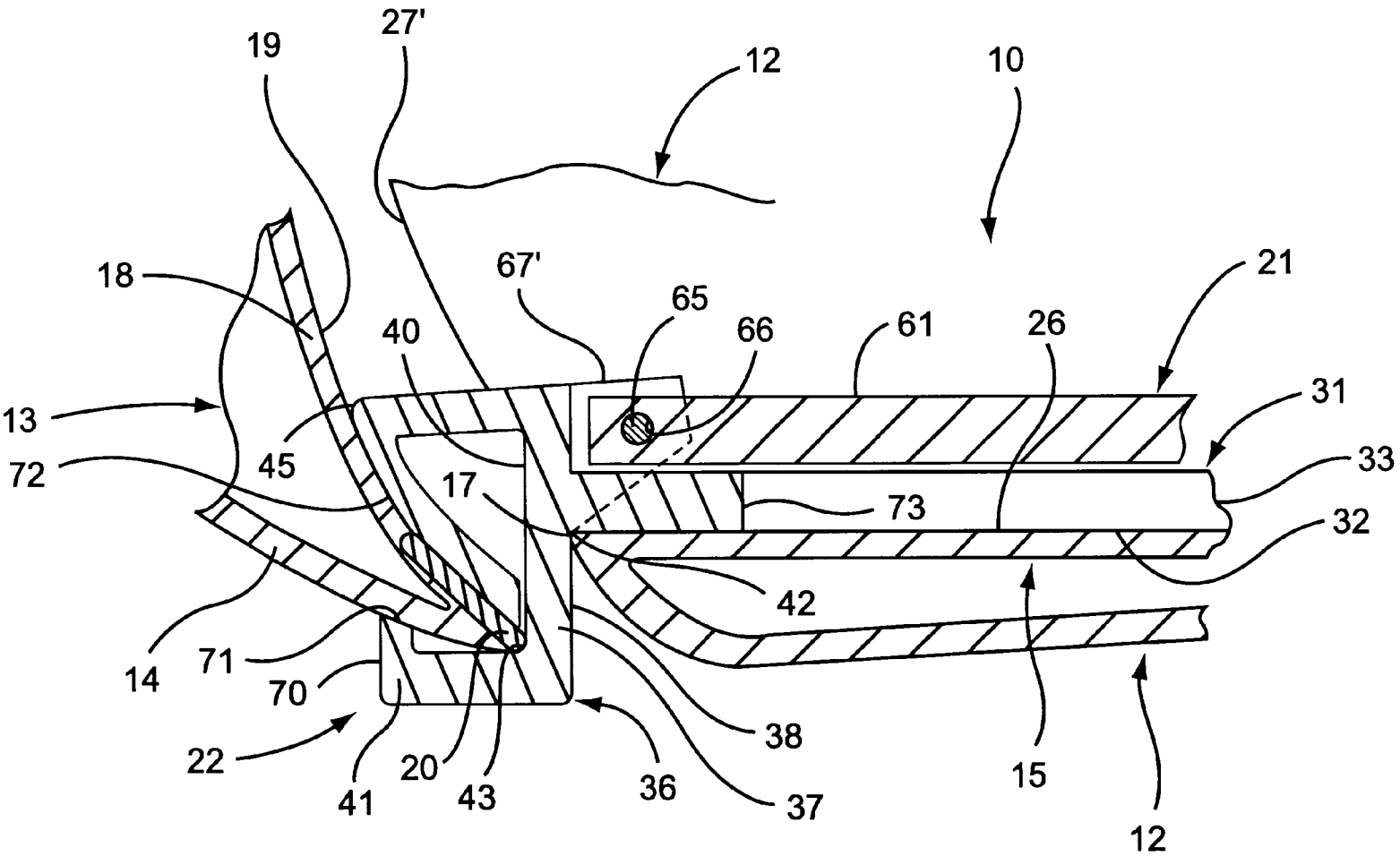
FIG. 12 is an enlarged, fragmentary, side perspective view, in cross-section, of the alternative embodiment lift attachment apparatus taken substantially along the plane of the line 12—12 in FIG. 11.

In another aspect of the present invention, the rear coupling member 36 may include an upstanding alignment lip 70, as best viewed in FIGS. 11 and 12, which is formed to abut or contact against a bottom surface 14 of the second jaw 13 of the loader bucket 11. When the loader bucket 11 is moved to the closed condition (FIG. 12) the distal contact surface 71 of the alignment lip 70 contacts the bottom surface 14 of the second jaw 13 and urges the upper lip portion 45 of the rear coupling member 36 into abutting contact with a top surface 19 of the rear engaging wall 18 of the second jaw 13. As the loader bucket 11 moves fully to the closed condition, the engaging edge 20 of the second jaw 13 aligns and seats in the rear intersection crease 43.

This sandwich configuration is beneficial in that the first jaw support member 15, and the top surface 19 and the bottom surface 14 of the engaging wall 18 of the second jaw 13 simultaneously engage the rear coupling member 36. Such engagement distributes the cantilever forces, caused by the weight of the object acting on the loader bucket across a substantial transverse portion of the support member of the first jaw and the bottom and top surfaces of the engaging wall of the second jaw. Moreover, the alignment lip 70 functions as a safety device by preventing the jaws from accidentally opening when loaded due to operator error.

As best viewed in FIG. 12, when a load is applied to the ends of the forklift prongs 21, a moment is formed with the tendency to pivot and lift the entire load bearing apparatus 10 off of the first jaw 12. However, the lower lip portion 41, and especially the distal contact surface 71 of the alignment lip 70, contacts the bottom surface 14 of the second jaw 13 to prevent opening separation between the first jaw 12 and the second jaw 13. Since the lower lip portion 41 extends rearwardly under the second jaw 13 for engagement with this stationary portion of the bucket, the collective load is more equally divided between the first jaw 12 and the second jaw 13.

Preferably, the alignment lip 70 upstands from the distal portion of the lower lip portion 41, and toward the bottom surface 14 of the second jaw 13, when in the closed condition. Similar to the lower lip portion 41, the upstanding alignment lip 70 preferably extends continuously from one side of the coupling member to the other side thereof. It will be appreciated, however, that the alignment lip 70 may be segmented across the rear coupling member 36 as well.

To provide further support distribution, the contacting portion 37 includes contacting wall 72 which is configured to seat substantially flush against a greater area of the top surface 19 of the engaging wall 18 of the second jaw 13 when in the closed position. This increased contact area between more evenly distributes the forces across the lower portion of the engaging wall 18 of the second jaw 13, as compared to the substantially smaller contact areas in the embodiment of FIGS. 1–5. Accordingly, when lifting substantial loads near the capacity recommended by the manufacturer of the loader bucket 11, potential damage to the second jaw 13 due to the more concentrated contact area is less likely to occur, if not eliminated, under normal operating conditions.

Preferably, in this configuration, the rearward facing surface of the contacting wall 72 substantially conforms to the contour of the top surface 19 of the engaging wall 18. Accordingly, when the loader bucket in the closed condition, the rearward facing surface of the contacting wall 72 is configured to seat substantially flush against the engaging wall 18 to distribute the lifting weight.

In one example, to reduce the collective weight of the rear coupling member 36, the contacting portion 37 is substantially hollow (FIG. 12). Thus, the contacting wall 72 depends downwardly from the distal end of the upper lip portion 45, and extends continuously from one side of the coupling member 36 to the other side thereof. Similar to the alignment lip 70, the contacting wall 72 may be segmented across the rear coupling member 36, as well. Further, to improve strength, one or more strengthening web members (not shown) may be spaced-apart along the contacting portion 37.

In another embodiment, the contacting portion 37 of the rear coupling member 36 may be easily fabricated from a hollow rectangular bar member. As shown in FIG. 12, a rear wall of one side of the bar member may be severed longitudinally therealong to expose the distal contact surface 71 and form the alignment lip 70. The contacting wall 72 may then be bent inwardly so that it extends from a top edge of the upper lip portion 45 to the intersection region 43 between the lower lip portion 41 and the rearward surface 40, as shown. Such arrangement substantially simplifies fabrication of the coupling member 36. reduces.

In still another embodiment of the present invention, as clearly viewed in FIG. 11, the load bearing member 31 may be substantially H-shaped. Similar to the embodiment of FIGS. 1–5, the wing portion 35 extends transversely outward from the body portion 33. To increase coupling strength to the rear coupling member 36, rear wing 73, 73' also extend outwardly from the body portion 33, and are substantially parallel to and adjacent the contact portion 37 of the rear coupling member 36. This enables increased rigidity and stability therebetween.

While this invention has been described in terms of several preferred embodiments, there are alterations, permutations, and equivalents which fall within the scope of this invention. For example, any conventional locking mechanism can be employed to retain the forklift prong in a fixed lateral relationship with the other prong. It is therefore intended that the following appended claims be interpreted as including all such alterations, permutations, and equivalents as fall within the true spirit and scope of the present invention.

What is claimed is:

1. A load bearing lift attachment apparatus for use with multipurpose loader bucket including a first jaw and a second jaw movably mounted to said first jaw between an opened condition and a closed condition, said first jaw having a support member transversely extending from one side to an opposite side of the loader bucket, and defining a front portion terminating at a transversely extending leading edge and an opposite rear portion terminating at a rear edge thereof, said second jaw including an engaging wall, having a top surface and an opposed bottom surface, transversely extending from the loader bucket one side to the opposite side thereof, and terminating at an engaging edge, said engaging wall being formed to engage the rear portion of the support member in the closed condition, said lift attachment apparatus comprising:

a lift member formed and dimensioned to engage an object to be lifted; and a support device removably coupling said lift member to the loader bucket, said support device including a load bearing member formed to extend transversely across an upper surface of the first jaw support member for support thereatop, and an elongated rear coupling member sized and structured to simultaneously engage the rear portion of the support member of the first jaw, and the top surface and the bottom surface of the engaging wall of the second jaw, in the closed condition, to distribute the cantilever forces, caused by the weight of the object acting on the loader bucket, across a substantial transverse portion of the support member of the first jaw and the engaging wall of the second jaw.

2. The lift attachment apparatus according to claim 1, wherein said elongated rear coupling member includes an alignment lip in abutting contact with the bottom surface of the engaging wall of the second jaw for supportive alignment thereof, when in the closed condition.

3. The lift attachment apparatus according to claim 2, wherein said elongated rear coupling member further includes a contacting portion having a forward surface and an opposed rearward surface, each extending transversely across a substantial portion of the rear edge of the first jaw support member, said forward surface being in abutting contact with the rear edge, and said rearward surface being in abutting contact with the engaging edge of the engaging wall, for supportive alignment therebetween, when said loader bucket is in the closed condition.

4. The lift attachment apparatus according to claim 3, wherein said rear coupling member further includes a lower lip portion extending rearwardly from said rearward surface of the contacting portion, to a position under the bottom surface of the engaging wall, when in the closed condition, and said alignment lip extends upwardly from the lower lip portion, toward the bottom surface of the engaging wall, for said abutting contact therewith.

5. The lift attachment apparatus according to claim 4, wherein said rear coupling member is formed and dimensioned such that when said loader bucket is moved to the closed condition, said engaging edge of the second jaw engaging wall substantially seats in an intersection region between the lower lip portion and the rearward surface of the contacting portion of the coupling member.

6. The lift attachment apparatus according to claim 4, wherein said contacting portion is formed and dimensioned to supportively seat against the top surface of said engaging wall when said loader bucket is in the closed condition.

7. The lift attachment apparatus according to claim 6, wherein said rearward surface of said contacting portion is formed to seat substantially flush against said top surface of the engaging wall of the second jaw when in the closed position.

8. The lift attachment apparatus according to claim 4, wherein said rearward surface of the contacting portion extends from a top edge thereof to an intersection region between the lower lip portion and the rearward surface such that when said loader bucket is moved to the closed condition, said engaging edge of the second jaw engaging wall substantially seats in the intersection region.

9. The lift attachment apparatus according to claim 1, wherein said lift member includes an elongated forklift prong portion extending forwardly of said load bearing member.

10. The lift attachment apparatus according to claim 9, wherein said lift member further includes a mounting device adapted to removably mount the lift member at one of a plurality of positions transversely along said load bearing member.

11. The lift attachment apparatus according to claim 10, wherein said mounting device includes a track assembly slideably mounting the lift member to the load bearing member to facilitate sliding displacement of the lift member laterally therealong.

12. The lift attachment apparatus according to claim 11, wherein said track assembly includes a support rod extending longitudinally across and substantially parallel to said rear coupling member, and said lift member includes a receiving passage formed and dimensioned for sliding receipt of the rod longitudinally therethrough for sliding lateral displacement of the lift member laterally along the load bearing member portion.

13. The lift attachment apparatus according to claim 1, wherein said load bearing member of said support device includes a body portion rigidly coupled to the rear coupling member, and a wing portion extending outwardly from the body portion, in a direction laterally across the first jaw support member.

14. The lift attachment apparatus according to claim 13, wherein said wing portion further extends in a direction substantially parallel to said leading edge of the first jaw support member.

15. The lift attachment apparatus according to claim 14, wherein said mounting device of the lift member further slideably cooperates with said wing portion to mount the lift member to the wing portion at said one of a plurality of positions transversely therealong.

* * * * *